United States Patent [19]

Schmid et al.

[11] Patent Number: 4,780,237

[45] Date of Patent: Oct. 25, 1988

[54] LOW FOAM SURFACTANT MIXTURES

[75] Inventors: Karl-Heinz Schmid, Mettmann; Adolf Asbeck, Duesseldorf; Detlev Stanislowski, Mettmann, all of Fed. Rep. of Germany

[73] Assignee: Henkel Kommanditgesellschaft auf Aktien, Duesseldorf, Fed. Rep. of Germany

[21] Appl. No.: 77,257

[22] Filed: Jul. 24, 1987

[30] Foreign Application Priority Data

Jul. 24, 1986 [DE] Fed. Rep. of Germany ..... 3625078

[51] Int. Cl.[4] ..... C11D 1/722; C11D 1/825

[52] U.S. Cl. ..... 252/174.22; 252/174.21; 252/321; 252/358; 252/DIG. 1

[58] Field of Search ..... 252/174.22, 321, 358, 252/DIG. 1, 174.21

[56] References Cited

U.S. PATENT DOCUMENTS

| | | | |
|---|---|---|---|
| 3,334,147 | 8/1967 | Brunelle et al. | 568/611 |
| 3,463,737 | 8/1969 | Kasper et al. | 252/153 |
| 3,491,029 | 1/1970 | Kasper et al. | 252/156 |
| 3,625,909 | 12/1971 | Berg et al. | 252/153 |
| 3,696,057 | 10/1972 | Schussler et al. | 252/544 |
| 4,272,394 | 6/1981 | Kaneko | 252/99 |
| 4,303,544 | 12/1981 | Kosswig et al. | 252/174.21 |
| 4,405,490 | 9/1983 | Maas et al. | 252/358 |
| 4,548,729 | 10/1985 | Schmid et al. | 252/174.21 |
| 4,622,303 | 11/1986 | Schmid et al. | 435/243 |

FOREIGN PATENT DOCUMENTS

| | | |
|---|---|---|
| 1172134 | 11/1969 | United Kingdom . |
| 1172135 | 11/1969 | United Kingdom . |

*Primary Examiner*—Paul Lieberman
*Assistant Examiner*—Ronald A. Krasnow
*Attorney, Agent, or Firm*—Ernest G. Szoke; Henry E. Millson, Jr.; Real J. Grandmaison

[57] ABSTRACT

Low-foam or foam-depressing surfactant mixtures based on water-soluble and/or water-emulsifiable polyalkylene glycol ethers of relatively long-chain alcohols containing components I, II and, if desired, III in the quantities indicated:

(I) from 20 to 80% by weight of polyethylene glycol ethers corresponding to the following general formula $$R_1-O-(CH_2CH_2O)_n-R_2 \quad \text{(I)}$$

in which $R_1$ is a straight-chain or branched $C_8$–$C_{18}$ alkyl or alkenyl radical, $R_2$ is a $C_4$–$C_8$ alkyl radical and n is a number of from 3 to 7, (II) from 10 to 40% by weight of alkyl polyalkylene glycol mixed ethers corresponding to the following general formula $$R_3-O-(CH_2CH_2O)_x-(CH_2-\underset{\underset{CH_3}{|}}{CH}O)_y-H \quad \text{(II)}$$

in which $R_3$ is a straight-chain or branched $C_8$–$C_{18}$ alkyl radical, x is a number of from 1 to 3 and y is a number of from 3 to 6, and (III) from 0 to 40% by weight of alkyl (poly)propylene glycol ethers corresponding to the following general formula $$R_4-O-(CH_2\underset{\underset{CH_3}{|}}{CH}O)_z-H \quad \text{(III)}$$

in which $R_4$ is a straight-chain or branched $C_{16}$–$C_{22}$ alkyl or alkenyl radical and z is a number of from 1 to 3.

11 Claims, No Drawings

LOW FOAM SURFACTANT MIXTURES

BACKGROUND OF THE INVENTION

1. Field of the Invention

This invention relates to low foam and foam depressing surfactant mixtures of water soluble and/or water emulsifiable polyalkylene glycol ethers of relatively long chain alcohols.

2. Statement of Related Art

Institutional and industrial aqueous cleaning preparations, particularly those intended for cleaning metal, glass, ceramic, and plastic surfaces, generally contain compounds which are capable of counteracting undesirable foaming. In most cases, the use of low-foam or foam-depressing surfactant-containing auxiliaries is necessitated by the fact that the various types of soil detached from the substrates to be cleaned and accumulating in the cleaning baths act as foam generators. This is particularly true for high-speed washing machines, for example bottle-washing machines, or in applications where the cleaning liquor is sprayed under high pressure onto the surfaces to be cleaned, for example, in spray cleaning.

Adducts of alkylene oxides with organic compounds containing reactive hydrogen atoms—preferably several reactive hydrogen atoms—in the molecule have long been successfully used as low-foam or foam-depressing additives with surfactant-like activity. Particularly good results have been obtained in practice with adducts of propylene oxide with aliphatic polyalcohols (cf. U.S. Pat. No. 3,491,029 and G.B. No. 1,172,135) and with polyamines (cf. U.S. Pat. No. 3,463,737 and G.B. No. 1,172,134) and with adducts of ethylene oxide and propylene oxide with aliphatic polyamines, particularly ethylenediamine (cf. U.S. Pat. No. 3,696,057). In addition to their favorable foam-suppressing or foam-depressing effect, alkylene oxide adducts such as these also show the alkali stability generally required for use in institutional and industrial cleaning preparations. Unfortunately, compounds of this class are not sufficiently biodegradable to meet the legal requirements of environmental protection legislation.

DESCRIPTION OF THE INVENTION

Other than in the operating examples, or where otherwise indicated, all numbers expressing quantities of ingredients or reaction conditions used herein are to be understood as modified in all instances by the term "about".

An object of the present invention is to provide foamdepressing or foam-suppressing surfactant-like mixtures for which the performance properties are at least equivalent to those of conventional additives, but which in addition show the required biological degradability. In particular, the invention seeks to provide such mixtures which can be effectively used even in the low temperature range below about 50° C. which, hitherto, has always been very difficult to master even with the best of the known additives.

U.S. Pat. No. 4,548,729 describes terminal-group-blocked polyethylene glycol ethers which may be used with advantage in the described fields of application and which, in addition, are biologically degradable. In practice, however, it has been found that these compounds develop their best activity at temperatures beyond about 50° C. and that improvements in their foaming behavior at lower temperatures appear desirable, particularly when they are used in cleaning processes which promote foaming from the mechanics of the measures applied.

It has now surprisingly been found that the surfactant mixtures described hereinafter are highly effective even at temperatures of +10° C. or higher, but at the same time enable any foam problems arising to be readily overcome. Accordingly, surfactant mixtures of the type according to the invention as described hereinafter are able, for example, to overcome difficulties arising during the so-called cold starting of bottle washing plants. The surfactant mixtures according to the invention can also be used with advantage as low-foam wetting agents for high-pressure cold-sprayable cleaning sprays.

In a first embodiment, therefore, the present invention relates to low-foam or foam-depressing surfactant mixtures based on watersoluble and/or water-emulsifiable polyalkylene glycol ethers of relatively long chain alcohols which are characterized in that they contain the following components I, II and , if desired, III in the quantities indicated (the quantities in % by weight are based on the total weight of the mixture of components I to III):

(I) from 20 to 80% by weight of polyalkylene glycol ethers of the formula $$R_1-O-(CH_2CH_2O)_n-R_2 \qquad (I)$$

in which $R_1$ is a straight-chain or branched $C_8$–$C_{18}$ alkyl or alkenyl radical, $R_2$ is a $C_4$–$C_8$ alkyl radical and n is a number of from 3 to 7, (II) from 10 to 40% by weight of alkyl polyalkylene glycol mixed ethers of the formula $$R_3-O-(CH_2CH_2O)_x-(CH_2-\underset{\underset{CH_3}{|}}{CHO})_y-H \qquad (II)$$

in which $R_3$ is a straight-chain or branched $C_8$—$C_{18}$ alkyl radical, x is a number of from 1 to 3 and y is a number of from 3 to 6, and (III) from 0 to 40% by weight of alkyl (poly)propylene glycol ethers of the formula $$R_4-O-(\underset{\underset{CH_3}{|}}{CH_2CHO})_z-H \qquad (III)$$

in which $R_4$ is a straight-chain or branched $C_{16}$–$C_{22}$ alkyl or alkenyl radical and z is a number of from 1 to 3.

The proportions by weight of components I to III preferably lie within the following quantitative ranges:

compounds of general formula I—from 50 to 80% by weight compounds of general formula II—from 10 to 30% by weight compounds of general formula III—from 0 to 20% by weight In a preferred embodiment, the radical $R_1$ in the compounds of general formula I is a straight-chain or branched $C_{12}$–$C_{18}$ alkyl or alkenyl radical while the preferred radical $R_2$ in these compounds of general formula I is the butyl radical. In the compounds of general formula II, the preferred meaning for the radical $R_3$ is a straight-chain or branched $C_{12}$–$C_{14}$ alkyl radical, while the preferred chain length for the radical $R_4$ in the compounds of general formula III is from 16 to 18 carbon atoms.

The radicals $R_1$, $R_3$ and $R_4$ are radicals of corresponding relatively long chain alcohols. In another preferred embodiment of the invention, alcohol cuts of the type obtained in the synthesis of such alcohols in practice are particularly suitable, in which case at least the predominant proportion of the individual components actually present in these alcohol cuts correspond to the C-chain length ranges indicated. Corresponding synthesis alcohols, especially corresponding fatty alcohols or fatty alcohol mixtures, of the type obtained in known manner from the conversion of natural fats and/or oils, are suitable.

One particularly suitable alcohol cut for the radical $R_1$ in the compounds of general formula I can be the so-called "LT-cocosalcohol" which shows the following carbon chain length distribution (for completely saturated hydrocarbon radicals):

| | |
|---|---|
| $C_{10}$ | 0 to 3% |
| $C_{12}$ | 48 to 58% |
| $C_{14}$ | 19 to 24% |
| $C_{16}$ | 9 to 12% |
| $C_{18}$ | 11 to 14% |

Alcohol cuts particularly suitable for the radical $R_3$ in the compounds of general formula II are the so-called "LS-cocosalcohol" with the following carbon chain length distribution (again for completely saturated hydrocarbon radicals):

| | |
|---|---|
| $C_{10}$ | 0 to 2% |
| $C_{12}$ | 70 to 75% |
| $C_{14}$ | 24 to 30% |
| $C_{16}$ | 0 to 2% |

An oleyl alcohol cut having the following carbon chain length distribution and an iodine number of from 40 to 110 is particularly suitable as the radical $R_4$ in compounds corresponding to general formula III:

| | |
|---|---|
| $C_{12}$ | 0 to 2% |
| $C_{14}$ | 0 to 9% |
| $C_{16}$ | 2 to 33% |
| $C_{18}$ | 60 to 95% |
| $C_{20}$ | 0 to 3%. |

The compounds corresponding to general formula I can be produced in accordance with U.S. Pat. No. 4,548,729, but with the difference that, in U.S. Pat. No. 4,548,729, the degree of ethoxylation n corresponds to a number of from 7 to 12 whereas, according to the invention, n is a number of from 3 to 7. Accordingly, suitable starting materials for the production of the polyglycol ethers corresponding to formula I are corresponding fatty alcohols and/or oxoalcohols containing the number of carbon atoms indicated either individually or in admixture with one another. These alcohols are reacted with ethylene oxide in a molar ratio of from 1:3 to 1:7, after which the hydroxyl groups present in the reaction product obtained are etherified. The reaction with ethylene oxide takes place under known alkoxylation conditions, preferably in the presence of alkaline catalysts. The etherification of the free hydroxyl groups is preferably carried out under the known conditions of Williamson etherification with straight-chain or branched $C_4$–$C_8$ alkyl halides, for example with n-butyl iodide, sec.-butyl bromide, tert.-butyl chloride, amyl chloride, tert.-amyl bromide, n-hexyl chloride, n-heptyl bromide and n-octyl chloride. As already discussed above, the corresponding $C_4$-alkyl halides are preferably used for this purpose. It is advisable to use the alkyl halide and alkali in a stoichiometric excess, for example of from 100 to 200%, over the hydroxyl groups to be etherified.

The compounds corresponding to formulae II and III are also produced in known manner by reaction of the starting alcohols or alcohol mixtures with ethylene oxide and propylene oxide (compounds of general formula II) and with propylene oxide (compounds of general formula III) under known alkoxylation conditions.

The biological degradability of the surfactant mixtures of the invention as determined by the officially stipulated methods (OECD) screening test, OECD, Paris 1976 (26181)) is above 80% BiAS removal for BOD/COD values of greater than 60%.

In another embodiment, the invention relates to the use of the low-foam or foam-depressing surfactant mixtures described earlier in aqueous surfactant-containing cleaning preparations intended for the cleaning of hard surfaces. Of particular interest in this respect are those cleaning processes which are accompanied by heavy foaming because of the mechanics used and/or the soil to be detached, more especially mechanical cleaning processes, such as spray cleaning or other high-pressure washing or rinsing processes. In one particularly important embodiment, the surfactant mixtures according to the invention are used in cleaning preparations which are also intended to be used at washing temperatures below 50° C. and more especially at washing temperatures of from about 10° to 50° C.

In the context of the invention, the expression "cleaning preparations" applies both to the ready-to-use aqueous solutions of the corresponding active constituents, and to the concentrates and/or mixtures of active components from which the in-use solutions are prepared. More particularly, the general teaching of the prior art applies in this regard.

For example, cleaning preparations for use in bottle washing machines or, generally, for spray cleaning or high-pressure cleaning contain, in addition to wetting agents, other typical constituents, namely builders and complexing agents, alkalis or acids, corrosion inhibitors and, optionally, antimicrobial agents and/or organic solvents. In addition to the surfactant mixtures of the invention, other surfactants that can be present are nonionic surfactants, such as polyglycol ethers obtained by addition of ethylene oxide onto alcohols, particularly fatty alcohols, alkylphenols, fatty amines and carboxylic acid amides, and anionic surfactants, such as alkali metal, amine and alkylolamine salts of fatty acids, alkylsulfuric acids, alkylsulfonic acids and alkylbenzene sulfonic acids. Suitable builders and complexing agents for the cleaning preparations include alkali metal orthophosphates, polymer phosphates, silicates, borates, carbonates, polyacrylates and gluconates, citric acid, nitrilotriacetic acid, ethylenediamine tetraacetic acid, 1-hydroxyalkane-1,1-diphosphonic acid, aminotri-(methylene phosphonic acid) and ethylenediamine tetra-(methylene phosphonic acid), phosphonoalkane polycarboxylic acids, such as for example phosphonobutane tricarboxylic acid, and alkali metal salts of these acids. Highly alkaline cleaning preparations, particularly for bottle washing, contain considerable quantities of caustic alkali in the form of sodium and potassium hydroxide. If special cleaning effects are required, the cleaning preparations can contain organic solvents for example alcohols, petroleum fractions, chlorinated hydrocarbons, and free alkylolamines.

The ready-to-use solutions can be mildly acidic to strongly alkaline.

The surfactant mixtures used in accordance with the invention are added to the cleaning preparations in such quantities that their concentration in the ready-to-use solutions is from 10 to 2500 ppm and preferably from 50 to 500 ppm.

In the following Examples, 6 low-foam or foam-depressing surfactant mixtures corresponding to the teaching of the invention are first provided (Examples 1 to 6 and then compared with a number of surfactants or surfactant mixtures which, although constitutionally similar, do not fall within the description of the surfactant mixtures of the invention (Comparison Examples 1 to 6).

In the standard test described in the following for testing the defoaming or foam-suppressing effect, the surfactant mixtures of the invention are compared with the surfactant mixtures of the Comparison Examples. It can be seen that almost all the surfactant mixtures of the invention show better antifoaming behavior than the surfactant mixtures of the Comparison Examples.

In addition to the requirements which its foaming behavior has to satisfy, however, a product can only be used in practice if it also shows satisfactory emulsifying power. To evaluate this parameter, the surfactants or surfactant mixtures to be tested are emulsified in a quantity of from 0.1 to 1% by weight in 1% by weight aqueous sodium hydroxide solution at room temperature. Only those products which do not cream up are suitable for use in practice.

The acknowledgement of this additional parameter demonstrates the superiority of the surfactant mixtures of Examples 1 to 6 according to the invention to those of Comparison Examples 1 to 6.

The defoaming effect is tested under the following conditions:

300 ml of a 1% by weight aqueous sodium hydroxide solution are kept at 20° C. in a double-walled 2-liter measuring cylinder. The defoaming and/or foam-depressing surfactant or surfactant mixture to be tested is added to this solution in a quantity of 0.1 ml. The liquid is circulated at a rate of 4 liters per minute by means of a peristaltic pump. The test liquor is taken in approximately 5 mm above the bottom of the measuring cylinder by means of a 55 cm long glass tube (internal diameter 8.5 mm, external diameter 11 mm), which is connected to the pump by a 1.6 meter long silicone hose (internal diameter 8 mm, external diameter 12 mm), and returned by free fall through a second glass tube (length 20 cm) arranged at the 2000 ml mark of the measuring cylinder.

A 1% by weight aqueous solution of the triethanolamine salt of tetrapropylene benzene sulfonate is used as the test foam generator. It is added to the circulating liquid in a quantity of 1 ml at intervals of 1 minute. The total volume of foam and liquid formed is determined. The longer the time taken by the total volume of liquid and foam phase to reach the 2000 ml mark of the measuring cylinder the better the foam inhibiting effect of the particular surfactant material tested. In Examples 1 to 6 below, the respective corresponding figures for this time are shown in minutes and in ml test foam generated. At the same time, the emulsifying power is assessed as described above, being evaluated as good, still satisfactory or inadequate.

The symbols "LT-", "LS-" and "OCENOL-" used in the Examples of the invention and the Comparison Examples relate to the radicals $R_1$ (compounds of general formula I), $R_3$ (compounds of general formula II) and $R_4$ (compounds of general formula III) and correspond to the definition given in the description of the invention of "LT-cocosalcohol", "LS-cocosalcohol", and of the oleyl alcohol cut with an iodine number of from 40 to 110.

The invention is illustrated but not limited by the following examples.

EXAMPLES

EXAMPLE 1

60 %: LT-5 EO-n-butyl ether of formula I
20 %: LS-2 EO-4 PO of formula II
20 %: Ocenol-2PO of formula III
Standing time in the defoaming test: 20
Emulsifying power: good

COMPARISON EXAMPLE 1

100%: Ocenol-2 PO
Standing time in the defoaming test: 18
Emulsifying power: inadequate

COMPARISON EXAMPLE 2

100%: ethylenediamine +30 EO+70 PO
Standing time in the defoaming test: 5
Emulsifying power: good

COMPARISON EXAMPLE 3

100%: LT-10 EO-n-butyl ether of formula I
Standing time in the defoaming test: 9
Emulsifying power: good

COMPARISON EXAMPLE 4

100%: LS-2 EO-4 PO of formula II
Standing time in the defoaming test: 13
Emulsifying power: inadequate

COMPARISON EXAMPLE 5

100%: LT-7 EO-n-butyl ether of formula I
Standing time in the defoaming test: 10
Emulsifying power: good

COMPARISON EXAMPLE 6

100%: LS-3 EO-6 PO of formula II
Standing time in the defoaming test: 10
Emulsifying power: still satisfactory

EXAMPLE 2

75 %: LT-5 EO-n-butyl ether of formula I
25 %: LS-2 EO-4 PO of formula II
Standing time in the defoaming test: 23
Emulsifying power: good

EXAMPLE 3

45 %: LT-5 EO-n-butyl ether of formula I
15 %: LS-2 EO-4 PO of formula II
40 %: Ocenol-2 PO of formula III
Standing time in the defoaming test: 19
Emulsifying power: still satisfactory

EXAMPLE 4

33.3%: LT-5 EO-n-butyl ether of formula I 33.3%: LS-2 EO-4 PO of formula II
33.3%: Ocenol-2 PO of formula III
Standing time in the defoaming test: 17
Emulsifying power: good

EXAMPLE 5

60 %: LT-7 EO-n-butyl ether of formula I
20 %: LS-2 EO-4 PO of formula II
20 %: Ocenol-2 PO of formula III
Standing time in the defoaming test: 18
Emulsifying power: good

EXAMPLE 6

60 %: LT-5 EO-n-butyl ether of formula I
20 %: LS-2 EO-4 PO of formula II
20 %: Ocenol-3 PO of formula III
Standing time in the defoaming test: 21
Emulsifying power: good A number of Formulation Examples (Examples 7 to 13 according to the invention) for the use of the new low-foam or foam-depressing surfactant mixtures according to the invention are given in the following.

EXAMPLE 7

Bottle washing detergent 75.0 % by weight caustic soda, prilled
15.5 % by weight sodium metasilicate . 5 $H_2O$
6.0 % by weight sodium tripolyphosphate
3.5 % by weight surfactant mixture of Example 2

EXAMPLE 8

Dishwashing detergent (domestic)

43.0 % by weight sodium tripolyphosphate
43.0 % by weight sodium metasilicate, anhydrous
5.0 % by weight soda
5.0 % by weight soda waterglass
3.0 % by weight surfactant mixture of Example 3
1.0 % by weight trichloroisocyanuric acid

EXAMPLE 9

Dishwashing detergent (institutional)

43.0 % by weight sodium tripolyphosphate
30.0 % by weight sodium metasilicate, anhydrous
22.5 % by weight soda
3.5 % by weight surfactant mixture of Example 1
1.0 % by weight trichloroisocyanuric acid

EXAMPLE 10

Dairy cleaning preparation 47.0 % by weight soda
30.0 % by weight sodium tripolyphosphate
10.0 % by weight sodium sulfate
5.0 % by weight sodium metasilicate, anhydrous
5.0 % by weight surfactant mixture of Example 2
3.0 % by weight sodium dichloroisocyanurate

EXAMPLE 11

A degreasing dip for metals was prepared by mechanically mixing the following components:
40 pbw sodium metasilicate pentahydrate
35 pbw sodium carbonate
20 pbw sodium tripolyphosphate
2.5 pbw sodium alkylbenzene sulfonate
2.5 pbw nonylphenol + 14 EO
5 pbw surfactant mixture of Example 6

Grease-soiled steel shapes were cleaned by dipping in a 4% by weight solution of this cleaning preparation at 40° C. The degreasing effect was very good and no troublesome foaming was observed.

EXAMPLE 12

A storable concentrate for cleaning metal surfaces was prepared by dissolving the following components in water:
30 pbw sodium caprylate
10 pbw borax
14 pbw sodium tripolyphosphate
10 pbw triethanolamine
2 pbw monoethanolamine
6 pbw surfactant mixture of Example 3
78 pbw water Iron surfaces were sprayed with a 1.5% by weight solution of this cleaning preparation (pH value 8.5) at 30° to 40° C. The cleaning effect was good and no troublesome foaming was observed.

EXAMPLE 13

A storable concentrate for cleaning metal surfaces was prepared by dissolving the following components in water:
25 pbw diethanolamine salt of isononanoic acid
20 pbw diethanolamine
1 pbw benztriazole
4 pbw surfactant mixture of Example 2
50 pbw water A 1% by weight solution of this cleaning preparation was used for the spray-cleaning of grey iron castings at 30° to 40° C. The cleaning effect was good and no troublesome foaming was observed.

We claim:

1. A low-foam or foam-depressing surfactant mixture comprising:

(I) from about 33 to about 80% by weight of at least one polyalkylene glycol ether of the formula $$R_1—O—(CH_2CH_2O)_n—R_2 \quad (I)$$

in which $R_1$ is a straight-chain or branched $C_8$–$C_{18}$ alkyl or alkenyl radical, $R_2$ is a $C_4$–$C_8$ alkyl radical and n is a number of from 5 to 7, (II) from about 10 to about 40% by weight of at least one alkyl polyalkylene glycol mixed ether of the formula $$R_3—O—(CH_2CH_2O)_x—(CH_2—\underset{\underset{CH_3}{|}}{CH}O)_y—H \quad (II)$$

in which $R_3$ is a straight-chain or branched $C_8$–$C_{18}$ alkyl radical, x is a number of from 1 to 3 and y is a number of from 3 to 5, and (III) from about 0 to about 40% by weight of at least one alkyl (poly)propylene glycol ether of the formula $$R_4—O—(CH_2\underset{\underset{CH_3}{|}}{C}HO)_z—H \quad (III)$$

in which $R_4$ is a straight-chain or branched $C_{16}$–$C_{22}$ alkyl or alkenyl radical and z is a number of from 1 to 3.

2. The surfactant mixture of claim 1, wherein components I to III are present in the following quantities:

I—from about 50 to about 80% by weight
II—from about 10 to about 30% by weight
III—from 0 to about 20% by weight.

3. The surfactant mixture of claim 1 wherein in component I, $R_1$ contains from 12 to 18 carbon atoms.

4. The surfactant mixture of claim 1 wherein in component I, $R_2$ is butyl.

5. The surfactant mixture of claim 3 wherein in component I, $R_2$ is butyl.

6. The surfactant mixture of claim 1 wherein in component II, $R_3$ contains from 12 to 14 carbon atoms.

7. The surfactant mixture of claim 1 wherein in component III, $R_4$ contains from 16 to 18 carbon atoms.

8. The surfactant mixture of claim 6 wherein in component III, $R_4$ contains from 16 to 18 carbon atoms.

9. The surfactant mixture of claim 1 wherein in component I, $R_1$ contains from 12 to 18 carbon atoms and $R_2$ is butyl, and in component II, $R_3$ contains from 12 to 14 carbon atoms and $R_4$ contains from 16 to 18 carbon atoms.

10. In an aqueous cleaning preparation, the improvement comprising the presence therein of from about 10 to about 2500 ppm of the surfactant mixture of claim 1.

11. The aqueous cleaning preparation of claim 10 wherein from about 50 to about 500 ppm of the surfactant mixture of claim 1 is present therein.

* * * * *